US006839028B2

(12) United States Patent
Lee

(10) Patent No.: US 6,839,028 B2
(45) Date of Patent: Jan. 4, 2005

(54) MICROSTRIP ANTENNA EMPLOYING WIDTH DISCONTINUITIES

(75) Inventor: Choon Sae Lee, Dallas, TX (US)

(73) Assignee: Southern Methodist University, Dallas, TX (US)

( * ) Notice: Subject to any disclaimer, the term of this patent is extended or adjusted under 35 U.S.C. 154(b) by 0 days.

(21) Appl. No.: 10/214,746

(22) Filed: Aug. 9, 2002

(65) Prior Publication Data

US 2003/0034920 A1 Feb. 20, 2003

Related U.S. Application Data

(60) Provisional application No. 60/311,096, filed on Aug. 10, 2001.

(51) Int. Cl.[7] ..... H01Q 1/24

(52) U.S. Cl. ..... 343/700 MS; 343/824; 343/830

(58) Field of Search ..... 343/700 MS, 824, 343/826, 829, 830, 846, 848

(56) References Cited

U.S. PATENT DOCUMENTS

| | | | | |
|---|---|---|---|---|
| 3,757,342 A | * | 9/1973 | Jasik et al. | 343/738 |
| 4,777,490 A | * | 10/1988 | Sharma et al. | 343/754 |
| 6,057,801 A | * | 5/2000 | Desclos et al. | 343/700 MS |
| 6,084,548 A | * | 7/2000 | Hirabe | 343/700 MS |
| 6,097,271 A | | 8/2000 | Kozakoff | 333/204 |
| 6,127,978 A | | 10/2000 | Uematsu et al. | 343/700 MS |
| 6,150,982 A | | 11/2000 | Bergstedt et al. | 343/700 MS |
| 6,313,798 B1 | | 11/2001 | Bancroft et al. | 343/700 MS |

OTHER PUBLICATIONS

C.S. Lee and K.H. Tseng, "Electrically Small Microstrip Antenna with Width Discontinuities," *Proceedings of IASTED, Banff, Alberta, Canada*, Jul. 10–17, 2002, pp. 1–4.

Roger Hill, "A Practical Guide to the Design of Microstrip Antenna," *A Practical Guide to the Design of Microstrip Antenna Arrays* (*Microwave Journal*), n.d., <http://www.testmart.com/news/newstmp.cfm/v/001~~. . . /news/mw_200103_1.cfm.html> (Aug. 2, 2002).

Jui–Han Lu, "Broadband Operation of a Slot–Coupled Compact Rectangular Microstrip Antenna With a Chip–Resistor Loading," *Proceedings National Science Council*, ROC (A), vol. 23, No. 4, 1999. pp. 550–554.

David M. Pozar, "Microstrip Antennas," *Proceedings of the IEEE*, vol. 80, No. 1, Jan. 1992, pp. 79–91.

* cited by examiner

*Primary Examiner*—Tuyet Thi Vo
(74) *Attorney, Agent, or Firm*—Oblon, Spivak, McClelland, Maier & Neustadt, P.C.

(57) ABSTRACT

An apparatus and method to reduce the size of a microstrip antenna without sacrificing antenna efficiency too much are described. The antenna structure includes discontinuity of strip width in the middle of the antenna patch to reduce the size of the antenna at a given resonant frequency. The antenna structure further includes a plurality of patches of differing widths connected to each other at junctions. The junctions are placed symmetrically to ensure maximum radiation at the boresight and also to further reduce cross-polarization levels. A coaxial feed is connected at a predetermined location near the center of a patch, having a narrower width, in order to match the input impedance of the antenna to the coaxial feed.

30 Claims, 10 Drawing Sheets

MICROSTRIP ANTENNA EMPLOYING WIDTH DISCONTINUITIES

CROSS REFERENCE TO RELATED APPLICATIONS

The present application is related to, and is entitled to the benefits of the earlier filing date of U.S. Provisional Patent application Ser. No. 60/311,096, entitled "Size Reduction of Microstrip Antennas," filed on Aug. 10, 2001, the entire contents of which being incorporated herein by reference.

BACKGROUND OF THE INVENTION

1. Field of the Invention

The present invention generally relates to microstrip antennas, and more particularly, to a microstrip antenna having symmetric width discontinuities at a patch portion for enabling reduction in antenna size without sacrificing antenna efficiency too much.

2. Description of the Related Art

Advances in digital and radio electronics have resulted in the production of a new breed of personal communications equipment posing special problems for antenna designers. As users demand smaller and more portable communications equipment, antenna designers are pressed to provide smaller profile antennas. Additionally, users of such communications equipment desire high data throughput, thus requiring antennas with wide bandwidths and isotropic radiation patterns. Moreover, antennas in such portable equipment are often randomly oriented during use, or used in environments, such as urban areas and inside buildings, that are subject to multipath reflections and rotation of polarization. Thus, an antenna in such devices should be sensitive to both horizontally and vertically polarized waves.

Wire antennas, such as whips and helical antennas are sensitive to only one polarization direction. As a result, they are not optimal for use in portable communication devices which require robust communications even if the device is oriented such that the antenna is not aligned with a dominant polarization mode. One solution is to use microstrip patch antennas, which are capable of generating linearly polarized radiation, as well as two orthogonal modes of polarized radiation, as is the case for circularly polarized energy. For a general discussion of Microstrip Antennas including general design parameters and performance characteristics, see Pozar, D., "Microstrip Antennas, including general design parameters and performance characteristics, see Pozar, D., "Microstrip Antennas," Proceedings of the IEEE, Vol.80, No.1, January 1992, pages 79–91, the entire contents of which being incorporated herein by reference.

Microstrip patch antennas are resonant radiating structures that can be printed on circuit boards. By feeding a number of these elements arranged on a planar surface, in such a way that their excitations are all in phase, a reasonably highly efficient antenna can be obtained that occupies a very small volume by virtue of being flat. Microstrip antennas do have some limitations, however, that reduce their practical usefulness. In general, microstrip antennas are known for their advantages in terms of lightweight, flat profiles, and compatibility with integrated circuits. A microstrip patch antenna comprises a dielectric sandwiched between a conductive ground plane and a planar radiating patch. Thus, microstrip patch antennas are useful alternatives for applications requiring a small and particularly thin overall size.

Patch antennas are commonly produced in half wavelength sizes, in which there are two primary radiating edges parallel to one another. It is known that the size may be further reduced if all of one of the primary radiating edges of a microstrip patch antenna is short circuited, permitting the size of the radiating patch to be reduced to a quarter wavelength. Additionally, it is known that the size may be reduced even further, to approximately one third the size of a half-wavelength antenna, if one of the primary radiating edges is partially shorted circuited. The short circuit is typically created by wrapping a thin sheet of copper foil to electrically connect the ground plane to the radiating patch. To simplify the manufacture of these antennas, shorting posts have been used in lieu of copper foil.

However, microstrip patch antennas are resonant structures with a relatively small bandwidth of operation and, therefore, are not optimal for wide bandwidth applications, such as data communications. It is known to improve the bandwidth of a rectangular patch antenna by placing non-driven, parasitic, patches parallel to the nonradiating edges of the driven patch.

FIG. 1 shows a typical quarter wavelength microstrip antenna 100. The antenna includes a dielectric layer 110 sandwiched between a conductive ground plane 120 and a conductive radiating patch 130. The radiating patch 130 is energized by a connection through a coaxial cable 150 to feed point 160. In microstrip antennas of this type, the length L and the width W of the radiating patch 130 are adjusted in a manner well known to those skilled in the art to achieve a desired resonant frequency.

Despite the fact that microstrip antennas have many advantages over other conventional antennas, implementation of patch antennas in wireless communications at low frequencies has been limited because the antenna becomes too large in practical applications as the frequency decreases. The length of a typical microstrip antenna has to be about half a wavelength in the substrate dielectric medium. It is known that to improve the bandwidth of a rectangular patch antenna it is possible to place non-driven, parasitic, patches parallel to the nonradiating edges of the driven patch. Although a simple alteration of the microstrip patch with symmetric sharp width discontinuities reduces the antenna size drastically, antenna efficiency, however, suffers as the antenna becomes small.

SUMMARY OF THE INVENTION

The present invention addresses and resolves the above-identified and other deficiencies with conventional microstrip antennas According to the present invention, an apparatus and method to reduce the size of a microstrip antenna without sacrificing antenna efficiency too much is described. When width discontinuities are introduced in a conventional rectangular microstrip antenna, the antenna size is substantially reduced and thus becomes electrically small with regard to a typical ½ wavelength radiating structure. Without more, a conventional microstrip antenna would lose efficiency at lower frequencies where the radiating surface is electrically small. The present invention addresses and resolves the antenna efficiency dilemma with conventional microstrip antennas by judicious placement of discontinuities in a width of the radiating structure.

The antenna structure includes discontinuity of strip width in a middle of an antenna patch to reduce the size of the antenna at a given resonant frequency, while not completely compromising radiation efficiency. The antenna structure includes a plurality of patches of differing widths connected to each other at one or more junctions. The junctions are symmetrically placed to ensure maximum radiation at the boresight and also to further reduce cross-polarization levels. A coaxial feed is connected at a predetermined location near the center of a patch of narrower width in order to match the input impedance of the antenna to the coaxial feed.

The antenna structure according to the present invention provides several advantages, over conventional antennas, such as low profile, easy fabrication and low cost. A simple structure is presented for size reduction of a microstrip antenna. Further, junctions formed by width discontinuities in the microstrip patch are effective in reducing the antenna size at a given resonant frequency without compromising radiation efficiency too much.

In one aspect, the present invention provides a microstrip antenna having a ground plane; a dielectric layer having a first surface overlying the ground plane, and a second surface opposing the first surface; an electrically conductive layer overlying the second surface, the electrically conductive layer including a plurality of patches of differing widths, each of the plurality of patches being connected via one or more junctions to at least another of the plurality of patches. A first patch among the plurality of patches is disposed between a second patch and a third patch of the plurality of patches, wherein the first patch has a narrower width compared to widths of the second and third patches so that respective junctions formed between the first and second patch, and the first and third patch define discontinuities in width therebetween. A feed is disposed in the first patch and configured to connect to a coaxial cable, and wherein the respective junctions formed between the first and second patches, and the first and the third patches are symmetrically disposed about the first patch.

The coaxial feed point is preferably disposed in the first patch at a location so as to match input impedance of the antenna to a coaxial feed. The junctions are symmetrically placed to ensure maximum radiation at antenna boresight and to reduce cross-polarization levels. Each of the junctions acts as an inductive load in series with an equivalent transmission line. The resonant operating antenna frequency varies with the length of the patches. The length of the first patch is preferably approximately twice the length of the second and third patches to produce a lowest resonant frequency. The second and third patches provide extra radiating edges.

In another aspect, the present invention provides in an electrically short microstrip antenna having a ground plane, a dielectric layer, an electrically conductive layer overlying a surface of the dielectric layer, a method of reducing size of the microstrip antenna comprising providing a plurality of patches of differing widths on the conductive layer; connecting the plurality of patches to adjacent patches at one or more junctions, the connecting step including disposing a first patch among the plurality of patches between a second patch and a third patch of the plurality of patches, wherein the first patch has a narrower width compared to widths of the second and third patches, so that respective junctions formed between the first and second patch, and the first and third patch define discontinuities in width therebetween; and symmetrically placing the one or more junctions about the first patch so as to ensure maximum radiation at antenna boresight and to reduce cross-polarization levels.

In a further aspect, the present invention provides a microstrip antenna having a ground plane; a dielectric layer having a first surface overlying the ground plane, and a second surface opposing the first surface; a plurality of patches of differing widths disposed on a conductive layer on the dielectric layer; means for connecting the plurality of patches to adjacent patches at one or more junctions, a first patch among the plurality of patches being disposed between a second patch and a third patch, wherein the first patch has a narrower width compared to widths of the second and third patches, respectively; means for launching radio frequency energy; and means for ensuring maximum radiation at antenna boresight and suppressing cross-polarization levels.

In a yet another aspect, the present invention provides a microstrip antenna having a plurality of patches of at least two different widths, each patch among the plurality of patches being connected to an adjacent patch at at least two junctions; a first patch among the plurality of patches disposed between a second patch and a third patch, the first patch having a narrower width than the second and third patches so that respective junctions formed between the first and second patch, and the first and third patch define discontinuities in width therebetween; a coaxial feed disposed in the first patch to launch radio frequency energy, a feed point in the first patch being provided at a predetermined location so as to match an input impedance of the microstrip antenna to the coaxial feed; and wherein the respective junctions formed between the first and second patch, and the first and third patch are symmetrically disposed about the first patch. The second and third patches are preferably rectangular in shape. Each of the second and third patches preferably form a double junction with the first patch.

In yet another aspect, the present invention provides a method for reducing a size of a microstrip antenna including disposing a first patch of predetermined width at a first location; joining the first patch to a second patch at at least two junctions, the second patch having narrower second width than the predetermined width of the first patch; connecting a third patch to the second patch at at least two junctions, the third patch having a greater width than the narrower second width; providing a feed in the second patch at a predetermined location so as to match input impedance of the antenna to the feed; and symmetrically placing the at least two junctions about the second patch so as to ensure maximum radiation at antenna boresight and to suppress cross-polarization levels.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

DETAILED DESCRIPTION OF THE EXEMPLARY EMBODIMENTS

Obviously, readily discernible modifications and variations of the present invention are possible in light of the above teachings. It is therefore to be understood that within the scope of the appended claims, the invention may be practiced otherwise than as specifically described herein.

Figure 2:
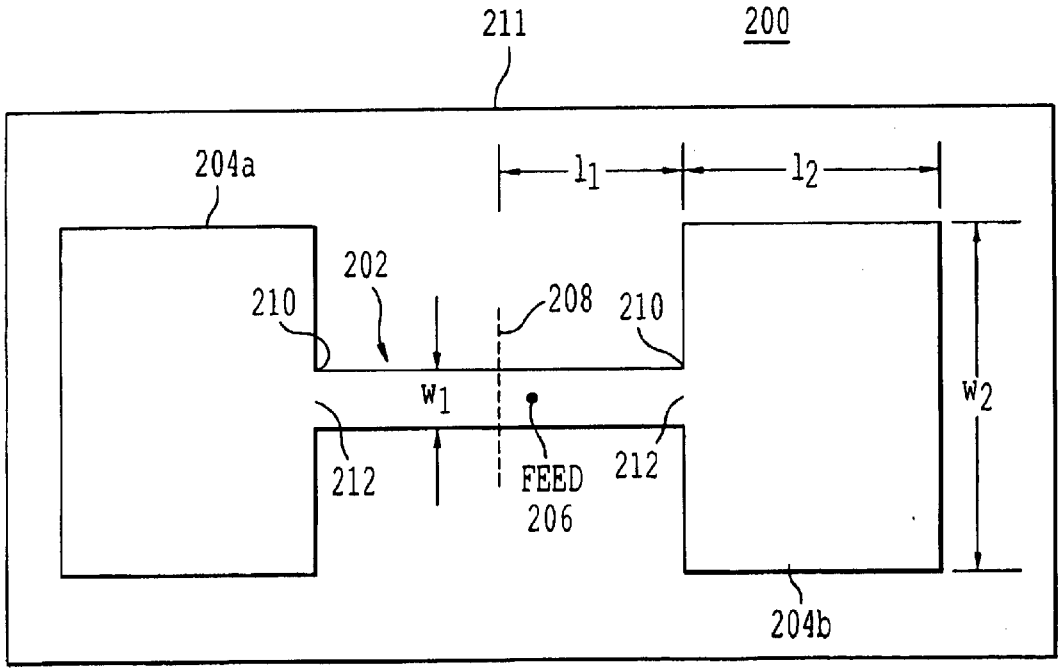
FIG. 2 illustrates a top view of the microstrip antenna in accordance with an exemplary embodiment of the present invention.

Referring to FIG. 2, there is shown a microstrip antenna 200 having a first patch 202 having a pair of edges 210. The first patch 202 includes a width $w_1$ and a resonant length $l_1$, wherein $l_1$ is designated to indicate half of the resonant length of the first patch 202. The first patch 202 is flanked on either side of the edges 210 by a pair of patches 204*a*, 204*b* of resonant length $l_2$ and width $w_2$, the width $w_2$ being larger when compared to the width $w_1$ of the first patch 202. While the patches 204*a*, 204*b* are preferably identical, a tolerance of +/10% size difference is believed to be acceptable. The first patch 202 is connected to patches 204*a*, 204*b* at junctions 212. The junctions 212 are placed symmetrically (ideally, identically symmetrical, although a deviation of anywhere between 0%–10% is believed to be tolerable) to ensure maximum radiation at the boresight and reduce the cross-polarization levels. The first patch 202 and the patches 204*a*, 204*b*, all are disposed upon a substrate layer 211. A coaxial feed is connected at a feeding point 206 which is near the center of the first patch 202 in order to match the input impedance. The centerline 208 of the first patch 202 is identified as a dashed line.

It is to be understood that the dimensions given have been selected to describe representative embodiments of antennas that operate at specific resonant frequencies. Additionally, it is to be understood that, for given desired resonant frequencies, different dimensions may result in better performance depending on parameters such as the location of the antenna in its end use and the like. Upon reading this specification, those skilled in the art, who will be familiar with tutorial papers such as David Pozar's paper cited above, will recognize that the technique of the present invention may be applied to a variety of antenna sizes in order to achieve a wide range of performance characteristics. In general, the present invention may be implemented on different size antennas by scaling the dimensions discussed herein. The dimensions of the present antenna are a suitable set for radiating (or receiving) energy in U.S. and European cellular and PCS bands, for example, as well as other mobile applications such as line-of-site satellite transmissions, such as for receiving XM RADIO transmissions, for example.

For an analytical characterization of the antenna according to the present invention, a cavity model is used in conjunction with a mode-matching technique. In the cavity model, all the opening edges are assumed enclosed by a perfect magnetic conductor. The field excitation under each path is expressed as a sum of modal fields that satisfy all the boundary conditions except at the junctions of the width discontinuity. By imposing continuity of both the electric and magnetic fields at the junctions, a matrix equation can be obtained for the resonant frequency. Assuming a constant magnetic field at the junction, a simple transcendental equation for the resonant frequency is derived as $$\tan kl_1 - \omega_1/\omega_2 \cot kl_2 + \delta = 0 \tag{1}$$

where k is the wave number in the dielectric medium. Here δ indicates the effect of the fringe fields near the junction, which is given by $$\delta = \sum_n k w_2^2 \sin^2(w_1/w_2 n\pi)/(w_1 n^3 \pi^3) \tag{2}$$

The resonant frequency is then evaluated using $$f = kC/(2\pi\sqrt{\epsilon_r}) \tag{3}$$

where C is the speed of light and $\epsilon_r$ is the dielectric constant of the substrate material. Note that when $w_1 = w_2$, δ vanishes and the resonant frequency becomes that of a regular microstrip antenna.

Figure 3:
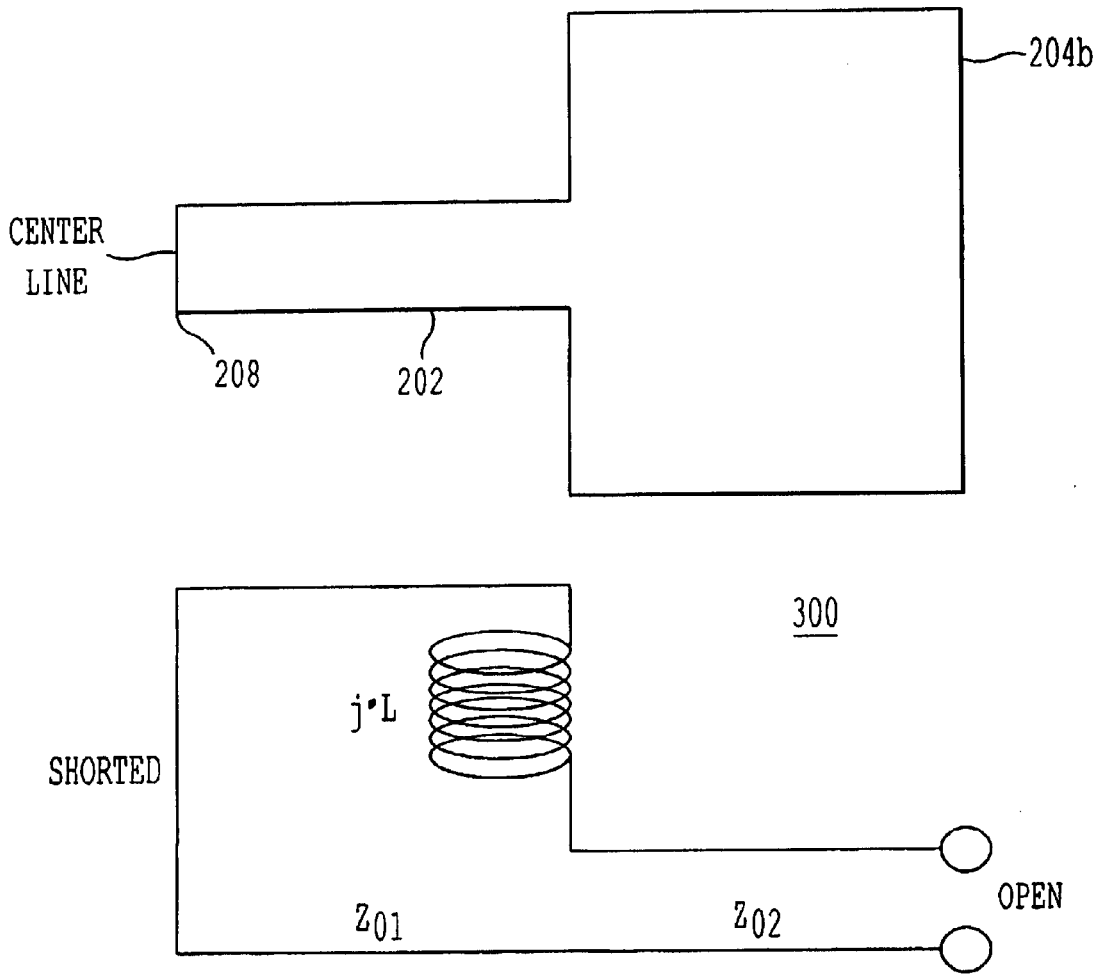
FIG. 3 is an equivalent circuit of the antenna as shown in FIG. 2.

In the above approximation the junction acts as an inductive load in series with an equivalent transmission line as shown in FIG. 3. Since the evanescent modal fields are confined near the junctions, the inductance of the equivalent load is nearly independent of the frequency.

In the above cavity-model approximation, the vertical walls at the strip edges are assumed enclosed by a perfect magnetic conductor (PMC). The approximation becomes less valid when the width $w_1$ of the first patch 202 becomes too small (i.e., approaching the substrate layer thickness). In order to stimulate the fringe fields at the edges 210 better, the inventors have used effective widths and dielectric constants for the first patch 202 and the parasitic patches 204*a*, 204*b*, respectively.

Figure 4:
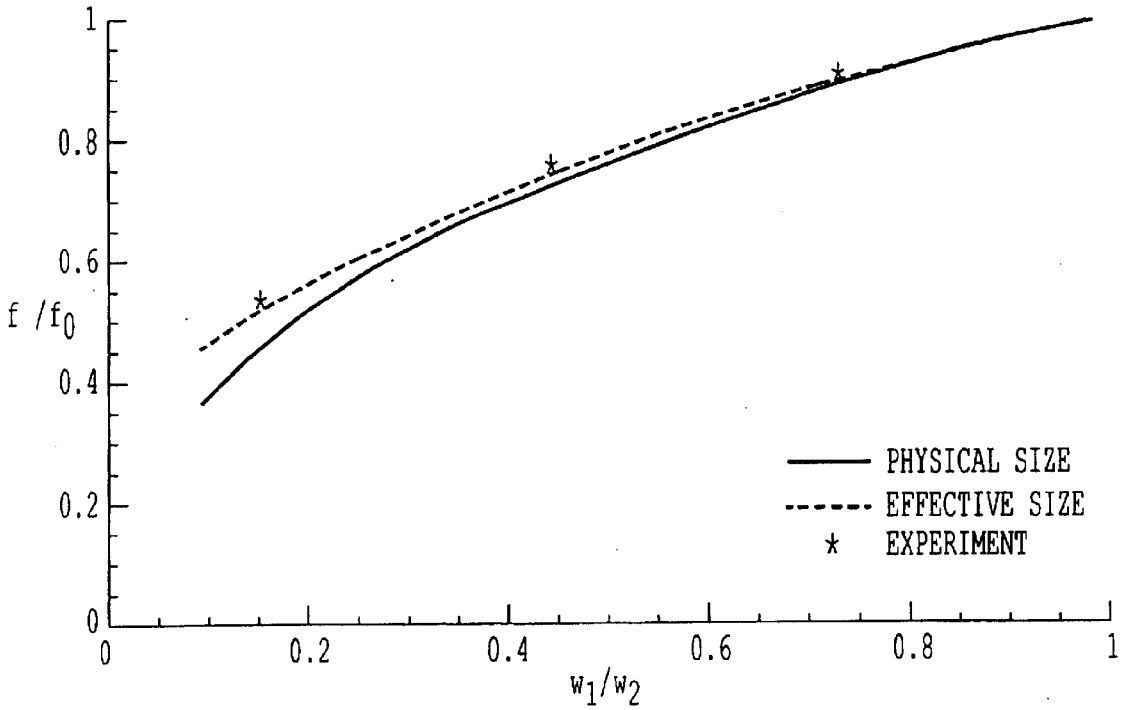
FIG. 4 is a graph illustrating the resonant frequency as a function of the width of the narrow patch while the width of the wider patch is fixed in accordance with an exemplary embodiment of the present invention.

Referring now to FIG. 4, there is shown a graph illustrating the resonant frequency as a function of the width of the first patch 202 while the width of the parasitic patch 204*b* is fixed in accordance with an exemplary embodiment of the present invention. Specifically, FIG. 4 shows the theoretical resonant frequencies as a function of the width of the first patch 202 in comparison with experimental data. As the width $w_1$ of the first patch 202 is reduced, the resonant frequency of the microstrip antenna 200 monotonically decreases, resulting in a small antenna size at a given resonant frequency. The exemplary graph shown in FIG. 4 illustrates the resonant frequency as a function of the width of the first patch 202 while the width of the parasitic patch 204*b* is fixed. Also, the following dimensions of the microstrip antenna structure were used to obtain the measurements illustrated in FIG. 4. $l_1$=20 mm, $l_2$=24 mm, $w_2$=34 mm, and thickness t=1.575 mm. The substrate material is RO5880 of Rogers Corporation with $\epsilon_r$=2.2 and the normalization frequency $f_0$ is 1.15 GHz, which is the resonant frequency when $w_1 = w_2$.

Figure 5:
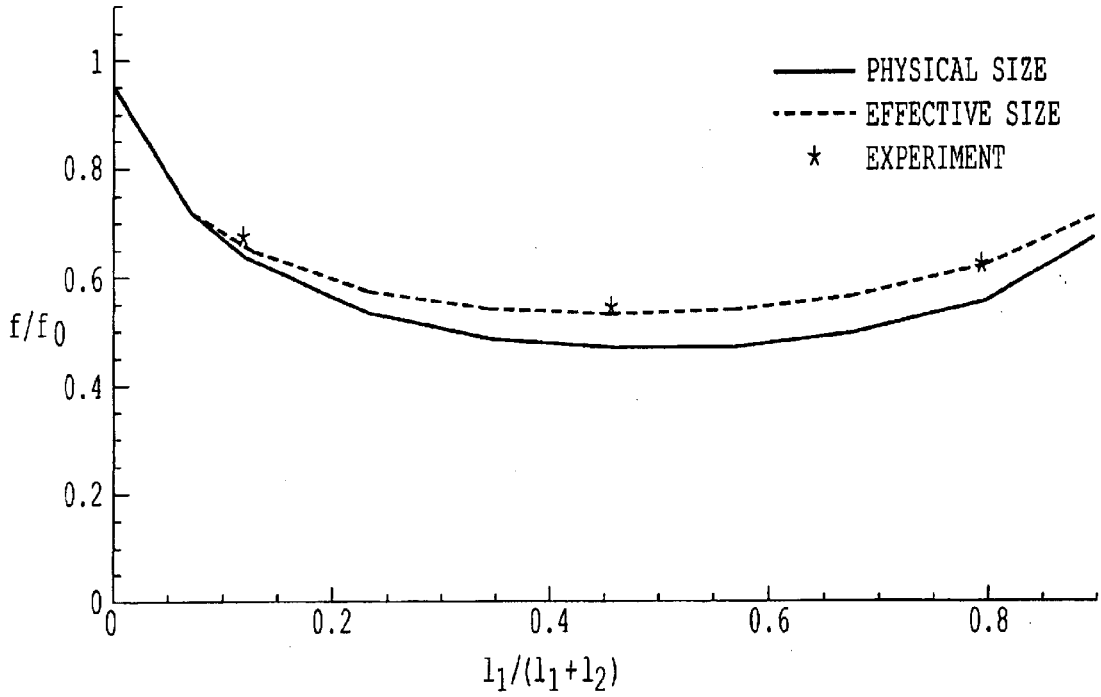
FIG. 5 is a graph illustrating the resonant frequency as a function of the length of the narrower patch while the total length of the antenna is kept constant in accordance with an exemplary embodiment of the present invention.

FIG. 5 is a graph illustrating the resonant frequency as a function of the length of the narrower patch while the total length of the antenna is kept constant in accordance with an exemplary embodiment of the present invention. From the illustrated graph of FIG. 5, one would observe that the lowest resonant frequency occurs when the length $2l_1$ of the first patch 202 is close to twice of that of the parasitic patches 204*a*, 204*b*. Also, the following dimensions of the microstrip antenna structure were used to obtain the measurements illustrated in FIG. 5. $l_1+l_2$=44 mm, $w_1$=5 mm, $W_2$=34 mm, and thickness t=1.575 mm. The substrate material is R05880 of Rogers Corporation with $\epsilon$=2.2 and the normalization frequency $f_0$ is 1.15 GHz, which is the resonant frequency when $w_1=W_2$.

Figure 6:
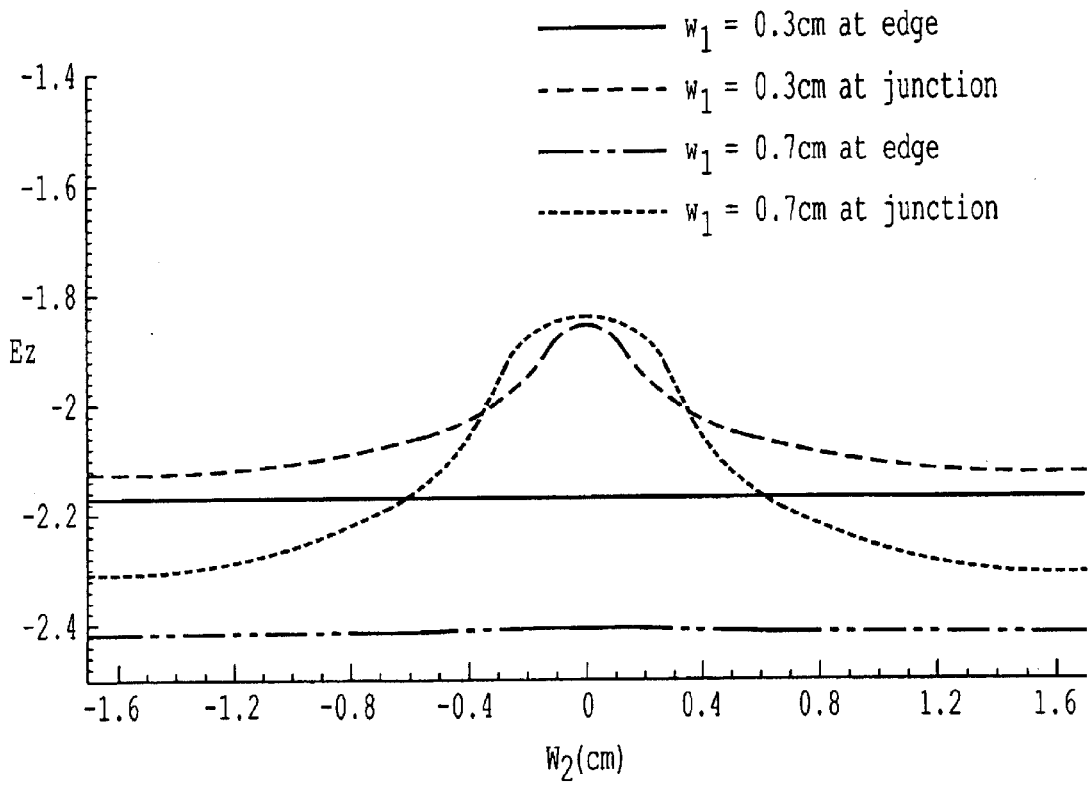
FIG. 6 is a graph illustrating electric field distribution in a Z-direction as the width of the wider patch $w_2$ is varied in accordance with an exemplary embodiment of the present invention.

Referring now to FIG. 6, there is shown a graph illustrating electric field distribution in a Z-direction as the width of the wider patch $w_2$ is varied in accordance with an exemplary embodiment of the present invention. FIG. 6 also illustrates the field distributions along the patch edges 210. The far-field patterns are computed by assuming magnetic currents on the opening edges. Compared with regular rectangular microstrip antennas, extra radiation edges are added to the antenna structure 200 of the present invention. Since the radiation from the added edges destructively interferes with that from the conventional radiating edges, the radiation efficiency decreases, and subsequently the bandwidth becomes smaller. Thus the larger the difference between the fields at the outer and inner edges is, the greater the radiation. The following dimensions of the microstrip antenna structure were used to obtain the measurements illustrated in FIG. 6. $l_1$=20 mm, $l_2$=24 mm, and thickness t=1.575 mm. The substrate material is RO5880 of Rogers Corporation with $\epsilon_r$=2.2.

Figure 7:
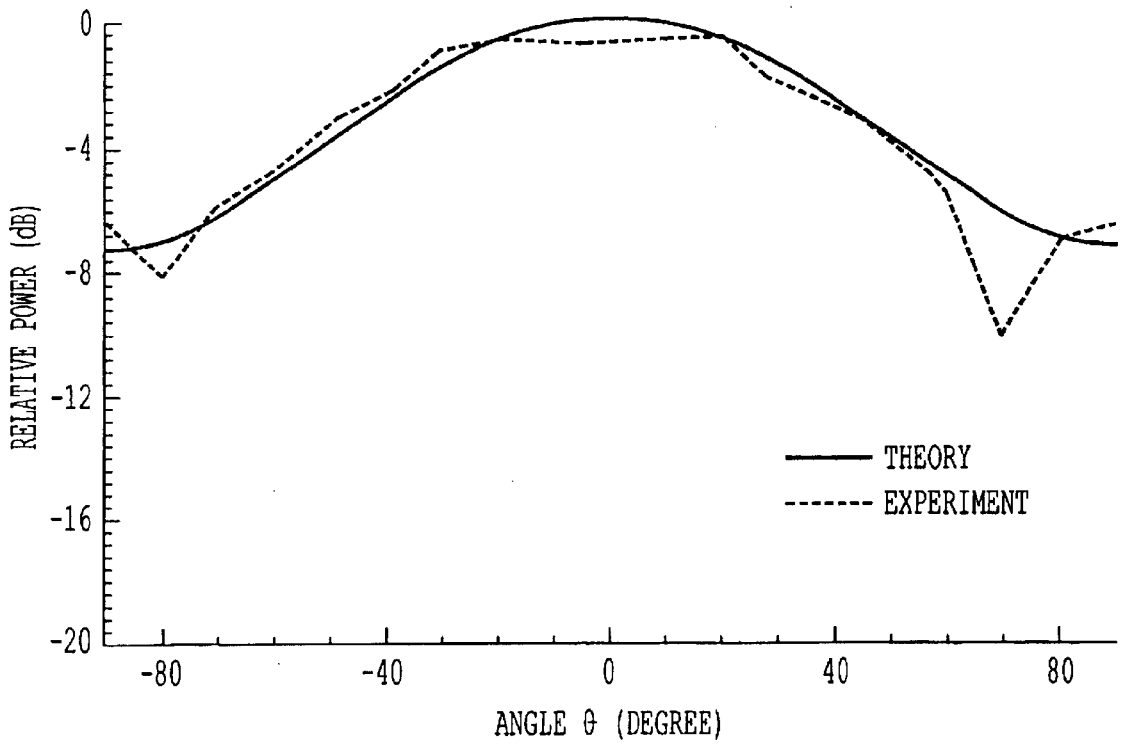
FIG. 7 is a graph illustrating an E-plane radiation pattern in accordance with an exemplary embodiment of the present invention.
Figure 8:
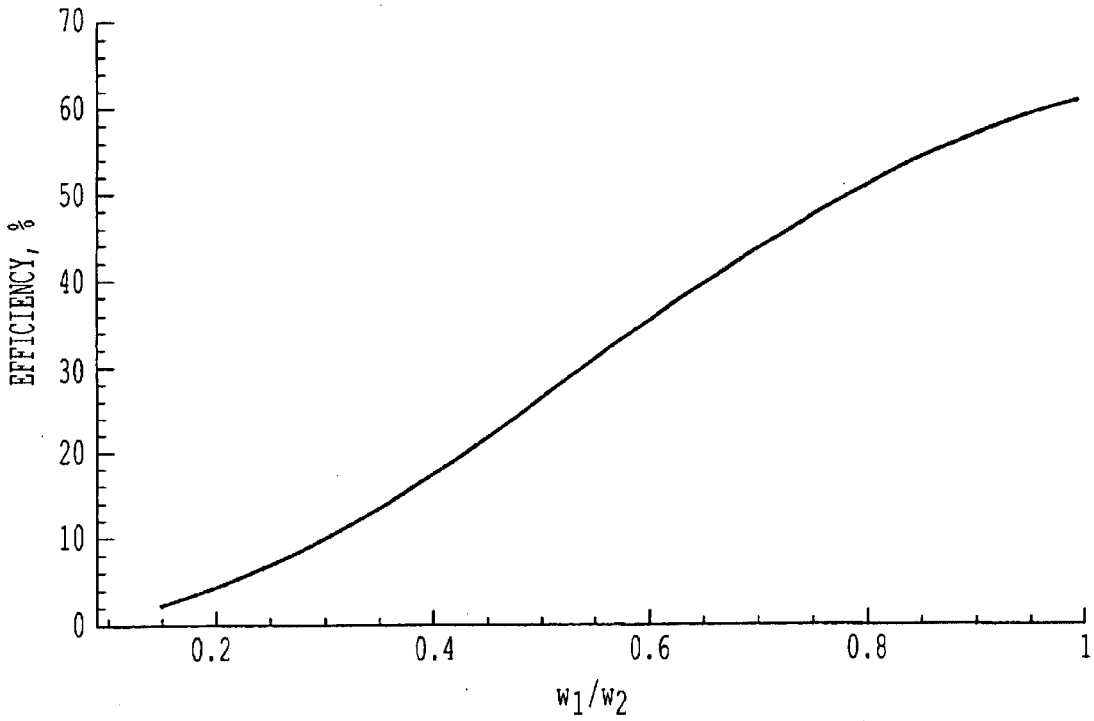
FIG. 8 is a graph illustrating the radiation efficiencies of the microstrip antenna in accordance with an exemplary embodiment of the present invention.

The inventors have determined that the theoretical E-plane radiation pattern is in relatively good agreement with the experimental data as shown in FIG. 7 which illustrates an E-plane radiation pattern in accordance with an exemplary embodiment of the present invention. The following dimensions of the microstrip antenna structure were used to obtain the measurements illustrated in FIG. 7. $l_1$=20 mm, $l_2$=24 mm, $w_1$=5 mm, $W_2$=34 mm and thickness t=1.575 mm. The substrate material is RO5880 of Rogers Corporation with $\epsilon_r$=2.2. As noted in FIG. 6, as the width of the first patch 202 decreases, the contribution from the added edges to the total radiation becomes more destructive. The computed radiation efficiencies are illustrated in FIG. 8 wherein the radiation efficiency decreases when the width of the first patch 202 becomes thinner to make the antenna structure smaller. The following dimensions of the microstrip antenna structure were used to obtain the measurements illustrated in FIG. 8. $l_1$=20 mm, $l_2$=24 mm, $W_2$=34 mm and thickness t=1.575 mm. The substrate material is RO5880 of Rogers Corporation with $\epsilon_r$=2.2.

Figure 9:
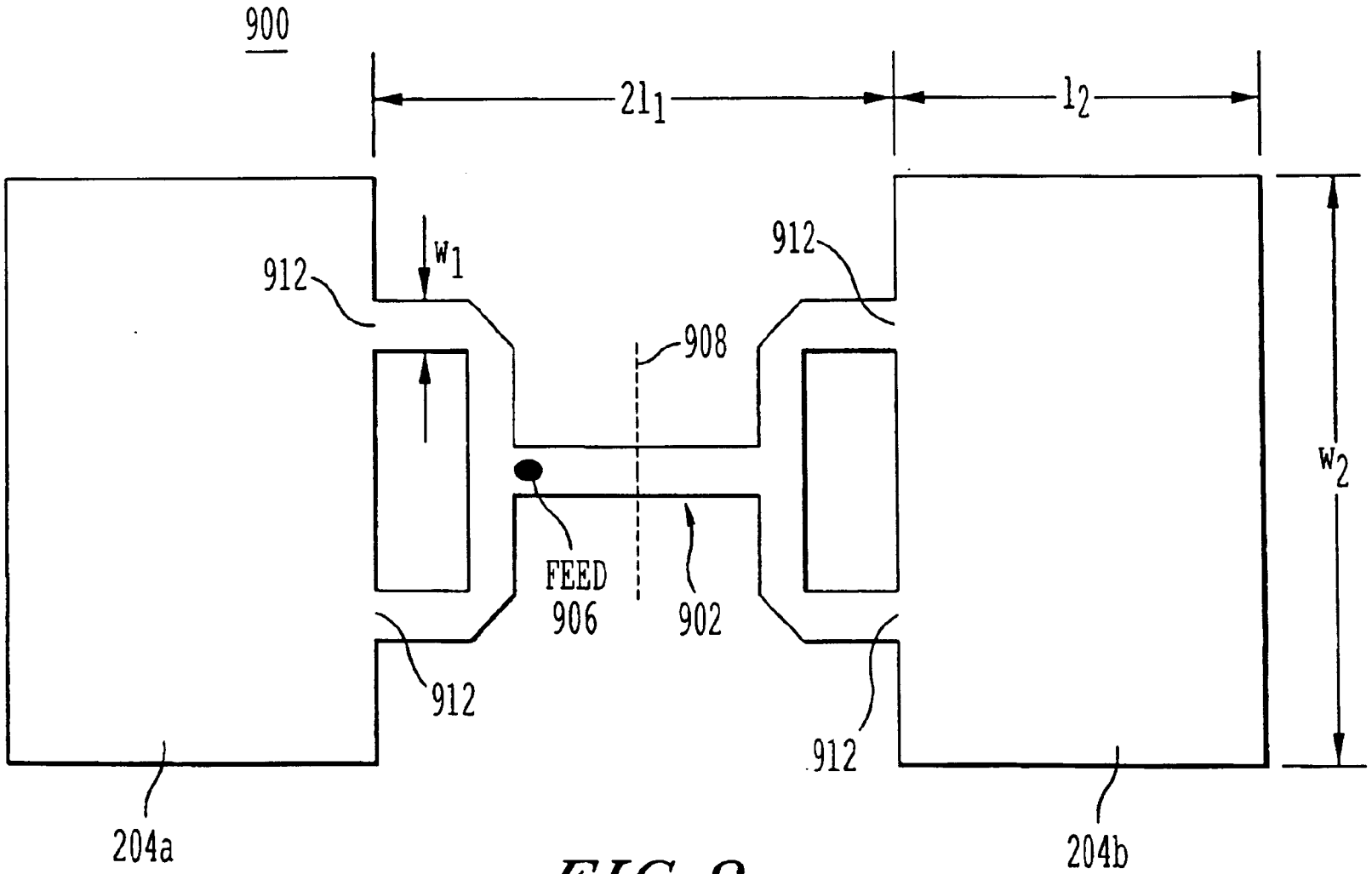
FIG. 9 is a top view of the microstrip antenna having symmetrically double junctions in accordance with a second embodiment of the present invention.

As seen in FIG. 6, most of the radiation comes from the near the junction of width discontinuity mainly due to the evanescent modes and the areas away from the junctions are not effective in contributing to the total radiated power. In order to utilize the area more effectively for radiation, double junctions 912 are symmetrically placed in the antenna structure as shown in FIG. 9 in another exemplary embodiment of the present invention. Elements that are common to the elements identified in FIG. 2 of the present invention are identified using like numerals. The resonant length of the first patch 902 is represented to be $2l_1$ and the width of the first patch is represented by $w_1$. The first patch 902 is flanked on either side by parasitic patches 204*a* and 204*b*. The first patch 202 is connected to the each of the parasitic patches by a double junction 912. An input for the feed is disposed at a position identified at 906 in order to match the input impedance of the antenna to the feed and also to reduce cross-polarization levels.

Figure 10:
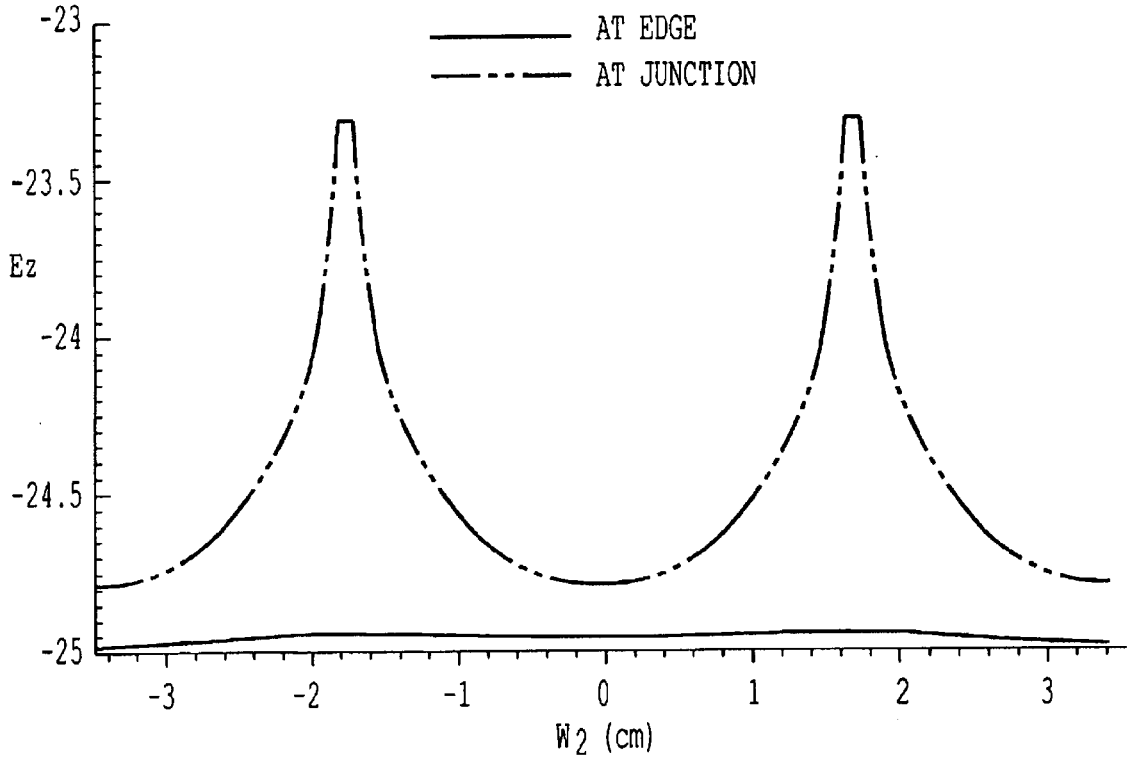
FIG. 10 is a graph illustrating the electric field distribution in a Z-direction of the antenna as shown in FIG. 9.

FIG. 10 is a graph illustrating the electric field distribution in a Z-direction of the antenna for the structure shown in FIG. 9. Compared with the single-junction structure as illustrated in FIG. 2, the field differences between the outer and added inner edges of the double junction structure as in FIG. 9 is more prominent in the modified patch than that of the original design in FIG. 2. The following dimensions of the microstrip antenna structure were used to obtain the measurements illustrated in FIG. 10. FIG. 10 more specifically illustrates the Z direction electric field distribution of antenna with double junction as width of wide patch $W_2$ changed, with $l_1$=20 mm, $l_2$=24 mm, $w_1$=1.5 mm.

Figure 1:
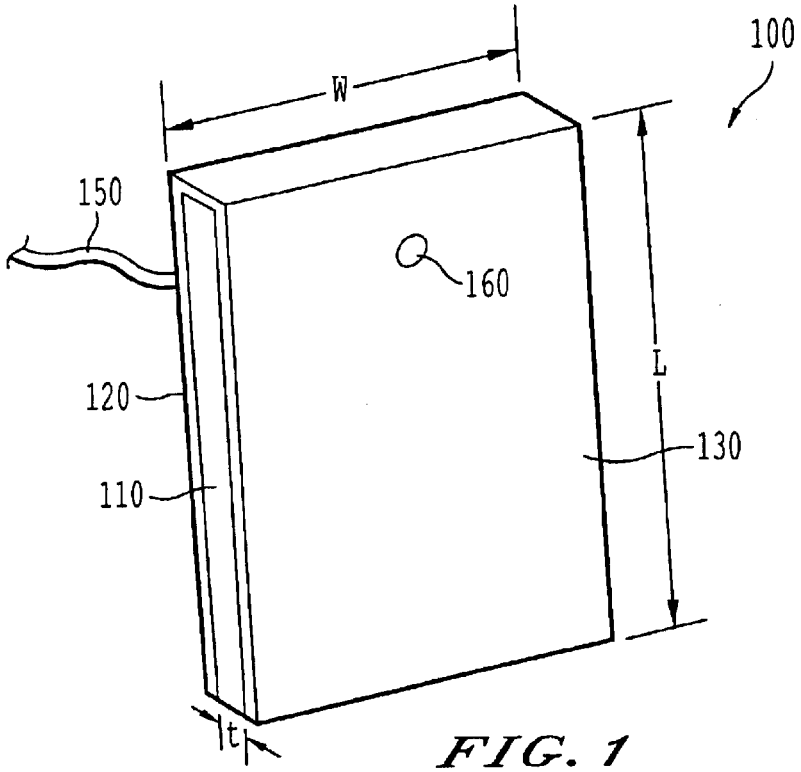
FIG. 1 PRIOR ART
FIG. 1 is a perspective view of a typical quarter wavelength microstrip antenna.
Figure 11:
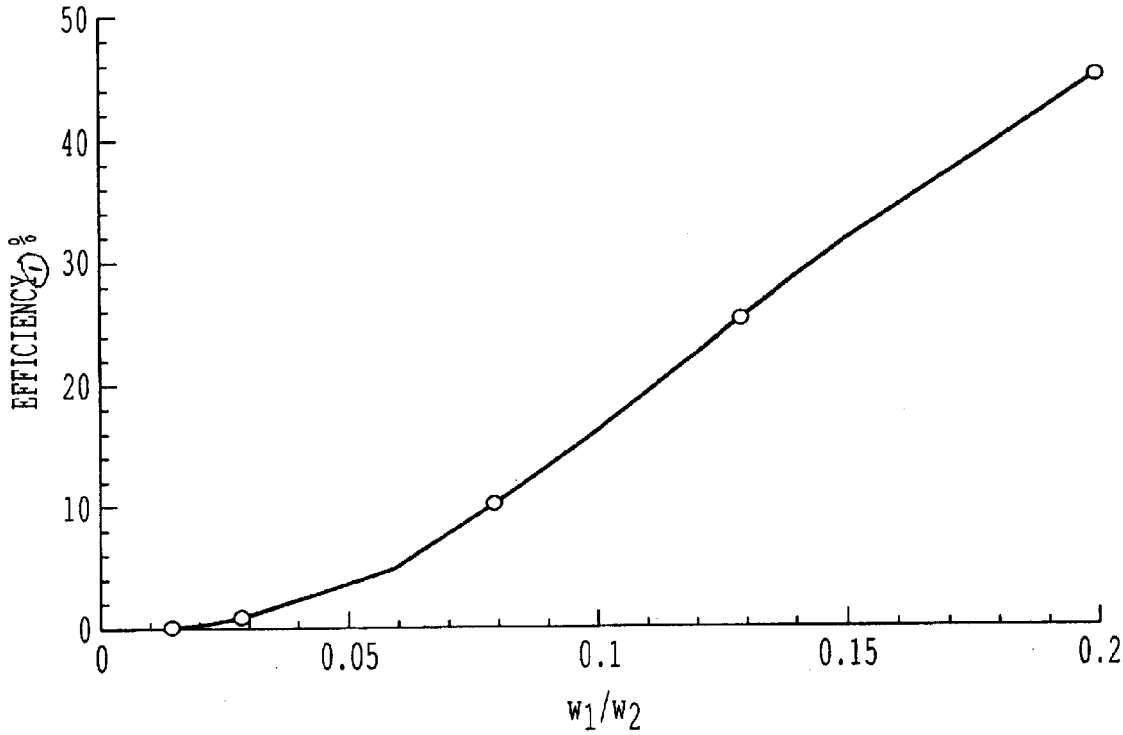
FIG. 11 is a graph illustrating the radiation efficiencies of the microstrip antenna shown in FIG. 9.

FIG. 11 is a graph illustrating the computed radiation efficiency for the microstrip antenna with a double junction structure as shown in FIG. 9. From the illustration of FIG. 1, one would note that the double junction structure shows a substantial improvement in antenna efficiency compared to the single junction structure. For example, for $W_1/W_2$ ratio of 0.2, the double junction structure shows efficiency of about 44% while the single junction structure for similar $w_1/w_2$ ratio shows an efficiency of about 5% as illustrated in FIG. 8. The following dimensions of the microstrip antenna structure were used to obtain the measurements illustrated in FIG. 11. $l_1$=20 mm, $l_2$=24 mm, $W_2$=70 mm and thickness t=1.575 mm. The substrate material is RO5880 of Rogers Corporation with $\epsilon_r$=2.2.

The present invention proposed a simple structure for size reduction of a microstrip antenna. Junctions formed by width discontinuities in the microstrip patch are shown to reduce the effective length for a resonating microstrip antenna while the antenna efficiency becomes small. The microstrip patch of the present invention is shown to increase the radiation efficiency of the antenna.

Thus, the foregoing discussion discloses and describes merely an exemplary embodiment of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

What is claimed is:

1. A microstrip antenna, comprising:

a ground plane;

a dielectric layer having a first surface overlying said ground plane, and a second surface opposing said first surface;

a substantially planar and electrically conductive layer overlying said second surface, said electrically conductive layer including a plurality of substantially co-planar patches of differing widths, each of said plurality of patches being connected via one or more junctions to at least another of said plurality patches;

a first patch among said plurality of patches is disposed between opposing edges of a second patch and a third patch of said plurality of patches, wherein said first patch has a narrower width compared to widths of said second and third patches so that respective junctions formed between the first and second patch, and the first and third patch define discontinuities in width therebetween;

a feed disposed in the first patch and configured to connect to a coaxial cable; and wherein said respective junctions formed between the first and second patch, and the first and the third patch are symmetrically disposed about the first patch.

2. The antenna as in claim 1, wherein the coaxial feed point is disposed in said first patch at a location so as to match input impedance of the antenna.

3. The antenna as in claim 1, wherein each of said junctions creates an inductive load in series with an equivalent transmission line as viewed by said feed.

4. The antenna as in claim 1, wherein said plurality of patches are configured to provide a quality factor that is inversely proportional to the width of said first patch.

5. The antenna as in claim 1, wherein said antenna is electrically small; and a resonant operating antenna frequency varies with an aggregate length of the plurality of patches.

6. The antenna as in claim 5, wherein a length of the first patch is about twice the length of said second and third patches so as to produce a lowest resonant frequency.

7. The antenna as in claim 6, wherein as the width of the first patch is reduced, a resonant frequency of the antenna monotonically decreases as a width of the first patch is reduced from a predetermined width.

8. A microstrip antenna, comprising:

a ground plane;

a dielectric layer having a first surface overlying said ground plane, and a second surface opposing said first surface;

an electrically conductive layer overlying said second surface, said electrically conductive layer including a plurality of patches of differing widths, each of said plurality of patches being connected via one or more junctions to at least another of said plurality of patches;

a first patch among said plurality of patches is disposed between opposing edges of a second patch and a third patch of said plurality of patches, wherein said first patch has a narrower width compared to widths of said second and third patches so that respective junctions formed between the first and second patch, and the first and third patch define discontinuities in width therebetween;

a feed disposed in the first patch and configured to connect to a coaxial cable; and wherein said respective junctions formed between the first and second patch, and the third patches each have additional radiating edges .

9. In an electrically short microstrip antenna having a ground plane, a dielectric layer, a substantially planar and electrically conductive layer overlying a surface of the dielectric layer, a method of reducing size of the microstrip antenna comprising:

providing a plurality of substantially co-planar patches of differing widths on the conductive layer;

connecting said plurality of patches to adjacent patches at one or more junctions, said connecting step including, disposing a first patch among said plurality of patches between opposing edge of a second patch and a third patch of said plurality of patches, wherein said first patch has a narrower width compared to widths of said second and third patches, so that respective junctions formed between the first and second patch, and the first and third patch define discontinuities in width therebetween; and symmetrically placing said one or more junctions about said first patch so as to ensure maximum radiation at antenna boresight and to reduce cross-polarization levels.

10. The method as in claim 9, further comprising:

providing a coaxial feed point in the first patch to launch radio frequency energy.

11. The method as in claim 10, wherein the providing step includes forming a coaxial feed point in said first patch at a predetermined location so as to match input impedance of the microstrip antenna to a coaxial feed.

12. The method of claim 10 wherein said first, second, and third patches each comprise a center point located on a common axis.

13. The method of claim 12, wherein said feed is located on said common axis and is not located at the center point of said first patch.

14. The method as in claim 9, further comprising a step of:

setting an aggregate length of the patches so as to set a resonant operating antenna frequency.

15. The method as in claim 14, further comprising a step of:

setting a length of the first patch to be about twice a length of said second and third patches so as to produce a lowest resonant frequency.

16. The method as in claim 15, further comprising the step of:

setting a width of the first patch to monotonically decrease the resonant operating frequency of the antenna relative to a ½ wavelength antenna structure.

17. In an electrically short microstrip antenna having a ground plane, a dielectric layer, an electrically conductive layer overlying a surface of the dielectric layer, a method of reducing size of the microstrip antenna comprising:

providing a plurality of patches of differing widths on the conductive layer;

connecting said plurality of patches to adjacent patches at one or more junctions, said connecting step including, disposing a first patch among said plurality of patches between opposing edges of a second patch and a third patch of said plurality of patches, wherein said first patch has a narrower width compared to widths of said second and third patches, so that respective junctions formed between the first and second patch, and the first and third patch define discontinuities in width therebetween;

symmetrically placing said one or more junctions about said first patch so as to ensure maximum radiation at antenna boresight and to reduce cross-polarization levels; and providing the second and third patches with additional radiating edges.

18. A microstrip antenna, comprising:

a ground plane;

a dielectric layer having a first surface overlying said ground plane, and a second surface opposing said first surface;

a plurality of substantially co-planar patches of differing widths disposed on a substantially planar conductive layer on said dielectric layer;

means for connecting said plurality of patches to adjacent patches at one or more junctions, a first patch among said plurality of patches being disposed between opposing edges of a second patch and a third patch, wherein said first patch has a narrower width compared to widths of said second and third patches, respectively;

means for launching radio frequency energy; and means for ensuring maximum radiation at antenna boresight and suppressing cross-polarization levels.

19. A microstrip antenna, comprising:

a plurality of patches of at least two different widths, each patch among said plurality of patches being connected to an adjacent patch at at least two junctions;

a first patch among said plurality of patches disposed between opposing edges of a second patch and a third patch, said first patch having a narrower width than said second and third patches so that respective junctions formed between the first and second patch, and the first and third patch define discontinuities in width therebetween;

a coaxial feed disposed in said first patch to launch radio frequency energy, a feed point in said first patch being provided at a predetermined location so as to match an input impedance of the microstrip antenna to the coaxial feed; and wherein said respective junctions formed between the first and second patch, and the first and third patch are symmetrically disposed about the first patch.

20. The microstrip antenna as in claim 19, wherein:

said second and third patches are rectangular in shape.

21. The microstrip antenna as in claim 19, wherein:

each of said second and third patches form a double junction with said first patch.

22. A method for reducing a size of a microstrip antenna, comprising the steps of:

disposing a first patch of predetermined width at a first location;

joining said first patch to a second patch at at least two junctions, said second patch having narrower second width than the predetermined width of said first patch;

connecting a third patch to said second patch at at least two junctions, said third patch having a greater width than the narrower second width;

providing a feed in said second patch at a predetermined location so as to match input impedance of the antenna to the feed; and symmetrically placing said at least two junctions about said second patch so as to ensure maximum radiation at antenna boresight and to suppress cross-polarization levels, wherein said second patch is located between opposing edges of said first and third patches.

23. The method as in claim 22, further comprising a step of: setting an aggregate length of the patches so as to set a resonant operating antenna frequency.

24. The method as in claim 23, further comprising a step of:

setting a length of the second patch to be about twice a length of said first and third patches so as to produce a lowest resonant frequency.

25. The method as in claim 24, further comprising the step of:

setting a width of the second patch to monotonically decrease the resonant operating frequency of the antenna relative to a ½ wavelength antenna structure.

26. The method as in claim 25, further comprising a step of: providing the first and third patches with additional radiating edges.

27. The method of claim 22 wherein said first, second, and third patches each comprise a center point located on a common axis.

28. The method of 27, wherein said feed is located on said common axis and is not located at the center point of said second patch.

29. The microstrip antenna as in one of claims 1, 8, and 19 wherein said first, second, and third patches each comprise a center point located on a common axis.

30. The microstrip antenna of claim 29, wherein said feed is located on said common axis and is not located at the center point of said first patch.

* * * * *